US009534395B2

(12) United States Patent
Haaslahti

(10) Patent No.: US 9,534,395 B2
(45) Date of Patent: Jan. 3, 2017

(54) STAIRCASE ELEMENT AND METHOD FOR BUILDING A STAIRCASE

(71) Applicant: Rakennus ja Tekniikka Haaslahti Oy, Pori (FI)

(72) Inventor: Mikko Haaslahti, Pori (FI)

(73) Assignee: RAKENNUS JA TEKNIIKKA HAASLAHTI OY, Pori (FI)

( * ) Notice: Subject to any disclaimer, the term of this patent is extended or adjusted under 35 U.S.C. 154(b) by 0 days.

(21) Appl. No.: 14/948,153

(22) Filed: Nov. 20, 2015

(65) Prior Publication Data

US 2016/0208495 A1 Jul. 21, 2016
US 2016/0319551 A9 Nov. 3, 2016

(30) Foreign Application Priority Data

Sep. 22, 2014 (FI) ..... 20145832
Jan. 20, 2015 (FI) ..... 20155041

(51) Int. Cl.
*E04B 1/30* (2006.01)
*E04F 11/032* (2006.01)
(Continued)

(52) U.S. Cl.
CPC ..... *E04F 11/032* (2013.01); *E04F 11/02* (2013.01); *E04F 11/025* (2013.01); *E04F 2011/0214* (2013.01)

(58) Field of Classification Search
CPC ..... E04F 11/025; E04F 11/032; E04F 2011/0214; E04F 11/028; E04B 1/30; E04B 1/165
(Continued)

(56) References Cited

U.S. PATENT DOCUMENTS 750,998 A * 2/1904 Ohnstrand ..... E04F 11/032 193/12
1,229,482 A * 6/1917 LeClair ..... E04F 11/032 52/187
(Continued)

FOREIGN PATENT DOCUMENTS

CN 201031475 Y 3/2008
FR 2653473 A1 4/1991
JP 2000160688 A 6/2000

OTHER PUBLICATIONS

Finnish Patent and Registration Office Search report for FI20155041 dated Aug. 27, 2015.

*Primary Examiner* — Rodney Mintz
*Assistant Examiner* — Daniel Kenny
(74) *Attorney, Agent, or Firm* — Berggren Inc.

(57) ABSTRACT

The invention relates to a staircase element comprising a tubular mast erectable to a vertical position onto the floor or a corresponding surface of a stair hall, and fillable with concrete;

stair step elements fastened at their first end stepwise to the mast and branching off radially from the mast;

at least one tubular stringer fastened to the second end of the stair step elements, fillable with concrete and connectable with fastening members to at least one wall of the stair hall, for supporting the stair step elements at their second end and for anchoring the staircase element to a building. The invention also relates to a method for building a staircase.

15 Claims, 4 Drawing Sheets

(51) Int. Cl.
*E04F 11/02* (2006.01)
*E04F 11/025* (2006.01)

(58) Field of Classification Search
USPC ..... 52/182, 185, 187, 191
See application file for complete search history.

(56) References Cited

U.S. PATENT DOCUMENTS 3,175,654 A * 3/1965 Calvert ..... E04F 11/02
182/178.5
3,430,729 A * 3/1969 Miceli ..... E04F 11/022
182/106
3,727,360 A 4/1973 Ollman
4,338,751 A * 7/1982 Sanders ..... E04F 11/032
52/187
4,527,366 A * 7/1985 Greene ..... E04F 11/025
182/83
4,660,331 A * 4/1987 Dahlen ..... E04B 5/43
52/283
5,491,939 A * 2/1996 Wang ..... E04F 11/02
52/185
5,983,580 A 11/1999 Carr
7,779,586 B2 * 8/2010 Stewart ..... E04H 1/04
52/175

* cited by examiner

STAIRCASE ELEMENT AND METHOD FOR BUILDING A STAIRCASE

PRIORITY

This application claims priority of the Finnish national applications number FI20145832 filed on Sep. 22 2014, and FI201455041 filed on Jan. 20 2015, the contents of both which are incorporated herein by reference in their entirety.

FIELD OF THE INVENTION

The invention relates to a staircase element and a method for building a staircase.

BACKGROUND OF THE INVENTION

At present, staircases built up from elements are normally assembled from uncoated concrete elements having the height of one flight. After the installation of the stair elements of the staircase, the steps of the staircase are coated with a suitable surface material, such as, for example, a mosaic or stone surface. The other surfaces of the staircase are also e.g. skim coated and/or painted after the installation of the staircase elements.

If the staircase is installed in an existing elevator or stair shaft, a foundation usually has to be made for the staircase to enable the installation of the staircase whose weight may often be as high as 15 000 kg. Moreover, it is laborious and time consuming to install heavy elements one by one and to fix them to each other. In many cases, it is also difficult and slow to coat the different surfaces of the staircase in a stair hall which is often narrow.

BRIEF SUMMARY OF THE INVENTION

It is an aim of the invention to provide a new type of a staircase element and a method for building a staircase, to avoid the above mentioned problems and to facilitate and accelerate the building of a staircase in an existing stair hall.

The aim of the invention is achieved, because the staircase element according to the invention is a prefabricated enclosed structure made of metal and coated before its installation, whereby concrete is cast in the cavities of the enclosed structure to increase the strength and the fire resistance, but the element is installed in the stair hall before the casting of the concrete, whereby its weight is so low that there is no need to construct a separate foundation, and the staircase element is also lighter than before and easier to handle during its installation. To put it more precisely, the staircase element according to the invention is characterized in what is presented in claim 1, and the method for building a staircase is characterized in what is presented in claim 9. Dependent claims 2 to 8 present some advantageous embodiments of the staircase element according to the invention. Dependent claims 10 to 15, in turn, present some advantageous embodiments of the method according to the invention.

The staircase element and the method according to the invention have the advantage that they make it easier and faster to install a fireproof staircase, because the staircase elements are, when installed, lighter in weight than concrete staircase elements of prior art, whereby there is no need to construct a separate foundation in the stair hall, and the installation of the staircase elements is easier because, among other things, the staircase elements can also be fastened to the walls of the stair hall during the installation.

Moreover, the building of the staircase becomes easier, because the separate installation of the steps and the coating of the staircase can be performed before the installation of the staircase, in connection with the fabrication of the staircase elements.

DESCRIPTION OF THE DRAWINGS

In the following, the invention will be described in more detail with reference to the appended drawings, in which.

DETAILED DESCRIPTION OF SOME ADVANTAGEOUS EMBODIMENTS OF THE INVENTION

Figure 1:
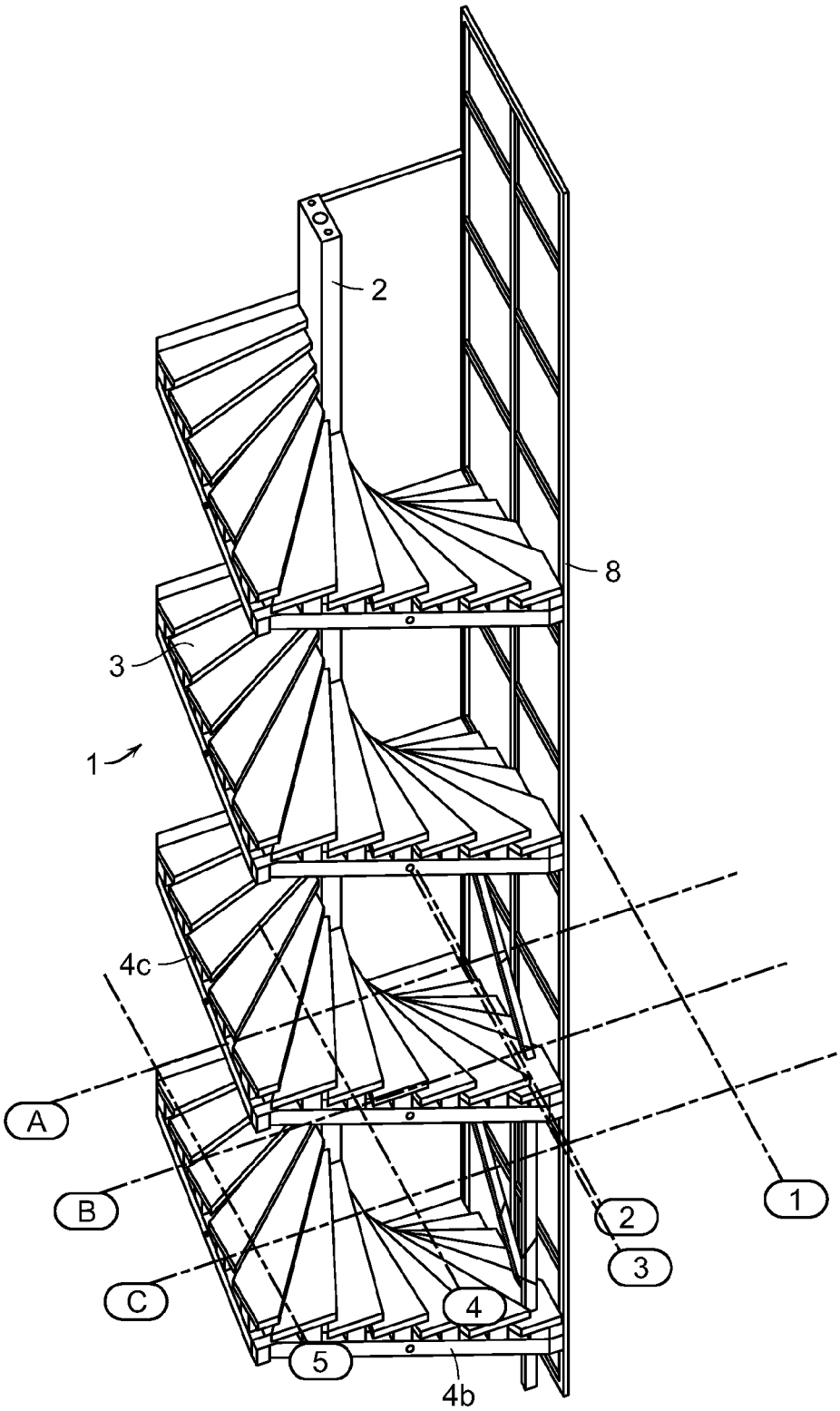
FIG. 1 shows a staircase built up from staircase elements according to the invention, separated from the building, seen in a slanted view from above, from the side of the stairs.
Figure 2:
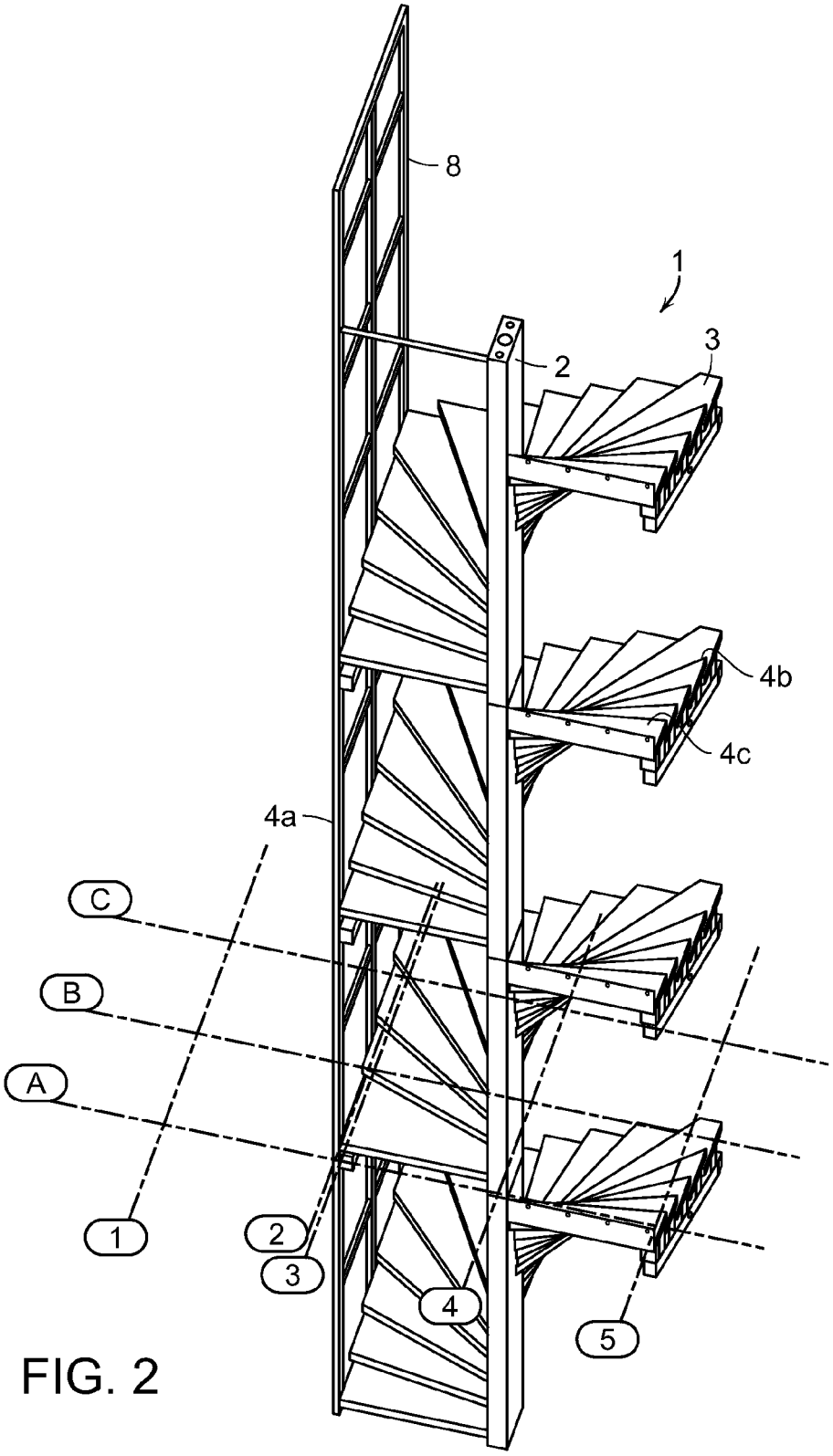
FIG. 2 shows the staircase of FIG. 1, separated from the building, seen in a slanted view from above, from the direction of the landings.
Figure 3:
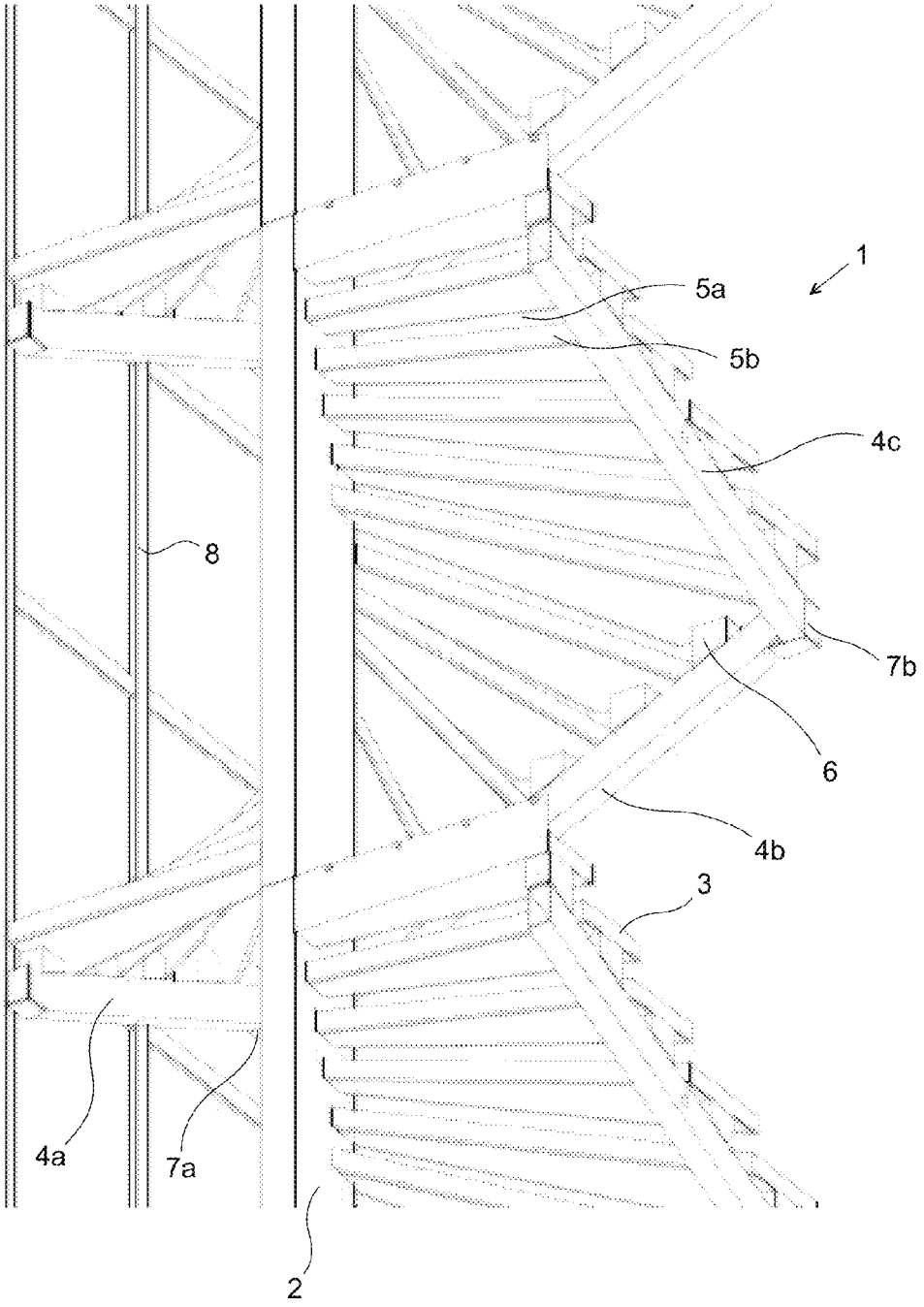
FIG. 3 shows the staircase according to the preceding figures, separated from the building, in a slanted view from below, from the direction of the landings.

FIGS. 1 to 3 show a staircase made of staircase elements 1 according to the invention. The staircase of FIGS. 1 to 3 is shown separately from the stair hall, in which landings would be provided, for example in FIG. 2 on the side of the viewer. In this case, the staircase according to FIGS. 1 to 3 comprises four staircase elements 1 installed on top of each other, each comprising one flight. Each staircase element comprises a mast 2, stair step elements 3 fastened at their first end spirally to the mast 2, surrounding it, as well as stringers 4*a* to 4*c* connected to the second ends of the stair step elements 3. The height of one staircase element 1 may be more than one flight as well. Advantageously, the height of the staircase element 1 is 1 to 3 flights, but in principle, it can be even greater than this.

The mast 2 constitutes a central axis for the staircase, surrounded by the staircase, the step elements 3 being fastened to it at their first end (on the side of the mast 2). Typically, the mast 2 is, for example, a box beam with a rectangular cross-section, whereby a hollow space is formed inside its walls, in which space concrete can be cast. The mast 2 is provided with at least one casting hole and at least one air exhaust hole so that air entrapped in the mast can exit the mast. The mast 2 can thus be a box beam whose cross-section is circular, oval or polygonal with more than four sides. One possibility is to make the mast polygonal so that each stair step element 3 could be transverse to the side to which said stair step element is fastened.

The stair step elements 3 comprise a base piece 5*a* and a cover piece 5*b*. The stair step elements 3 are fastened at their first ends to the sides of the mast 2. The easiest way to fasten them is to fix the base pieces 5*a* of the stair step elements 3 to the sides of the mast 2 by welding, but also other fixing methods could be applied, such as screws or riveting, or the like. Thus, the cover piece 5*b* can also be fastened to the side of the mast 2.

In the staircase element 1, the step elements 3 are placed in such a way with respect to the mast 2 that in the vertical direction of the mast 2, they extend in a transverse direction with respect to the mast 2, radially from it. In the direction of the height of the mast 2, single stair step elements 3 are typically spaced by intervals of e.g. about 18 cm, whereby they form stairs winding around the mast from the bottom upwards and having a suitable pitch and run between the steps (according to guidelines). In e.g. a staircase element 1 according to FIGS. 1 to 3, the run (width) of the stair step elements 3 is selected so that the total height for a rotation of 180° corresponds to the height of one flight. In the embodiment of FIGS. 1 to 3, the second end of the stair step elements 3 (the end extending away from the mast 2), fastened to the stringer 4*a*, 4*b* or 4*c*, is designed so that the stringer closely follows the walls of the stair hall.

In the embodiment of FIGS. 1 to 3, the base pieces 5*a* of the stair step elements 3 are e.g. plate-like metal pieces with front and rear edges bent downwards. Such bends are used to secure that the step elements have sufficient rigidity. The cover pieces 5*b* are typically made of a fire resistant material so that the cover piece 5*b* can act as a load bearing structure in a fire situation. Typically, the cover piece 5*b* consists of cast aggregate material (e.g. concrete) which is reinforced so that the cover piece 5*b* will act as a load bearing structure if the base piece made of metal loses its load bearing capacity due to heat. Another function of the cover piece 5*b* is to provide the stair step element 3 with a wear resistant and aesthetically attractive coating. Typically, the top surface of the cover piece 5*b* is provided with a stone or mosaic pattern, or the like. The cover pieces 5*b* are fastened to the base pieces 5*a* by non flammable adhesive. The advantage of such a fastening method is that the installation of separate fastening members is avoided. Furthermore, such a fastening method can be easily automated in connection with the fabrication of staircase elements 1.

In the embodiment of FIGS. 1 to 3, three stringers 4*a* to 4*c* are provided. Seen from above, the second stringer 4*b* is transverse to the first stringer 4*a*, and the third stringer 4*c* is transverse to the second stringer 4*b*, that is, parallel with the first stringer. Thus, the staircase elements shown in FIGS. 1 to 3 are intended to be installed in a rectangular stair hall. It is true that a stair hall of a different shape is possible, but in such a case the stair hall has to be so large that the framework formed by the stringers 4*a* to 4*c* can be fitted within it. For example in the case of a circular stair hall, it would be possible to use, for example, only one curved stringer instead of the stringers 4*a* to 4*c*, the curvature being the same as the curvature of the inner surface of the walls of the hail with a circular horizontal cross-section. Seen directly from the side, the stringers 4*a* to 4*c* are naturally in a position that is inclined to the horizontal plane by an angle determined by the pitch of the stairs, because they are typically always fastened to the sides of the stair step elements. In the embodiment of FIGS. 1 to 3, intermediate pieces 6 are provided between the base pieces 4*a* of the stair step elements 3 and the stringers 4*a* to 4*c* and fastened to the top surface of the stringers, the base pieces 5*a* of the stair step elements being fastened to the upper ends of the intermediate pieces 6. All these joints, too, are most typically welded joints. Between the stringers 4*a* to 4*c*, connecting pieces 7*a* and 7*b* are provided, which fasten the stringers 4*a* to 4*c* to each other tightly so that concrete cast from the end of the first stringer 4*a* can rise via the connecting piece 7*a* to the second stringer 7*b* and via the connecting piece 7*b* to the third stringer 4*c*.

The side surfaces of the stringers 4*a* to 4*c* are (usually beforehand) provided with screw holes (not shown in the figures), via which the staircase element is installed on the wall of the stair hail. These holes can also be made first during the installation of the staircase element 1, for example if it is, for any reason, not possible or reasonable to position them correctly before the installation of the staircase element.

Figure 4:
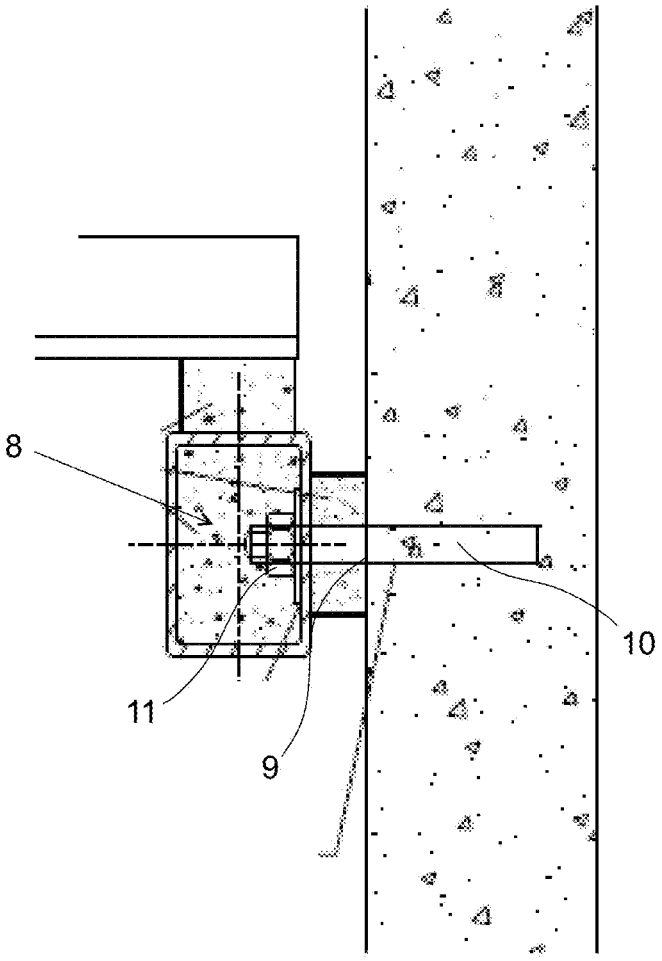
FIG. 4 shows a schematic drawing of a fixing arrangement suitable for fixing the staircase elements used in the staircase according to the preceding figures.

The fastening of one or more stringers 4*a* to 4*c* to the wall of the stair hall can be done by, for example, the fastening members 8 shown in FIG. 4. When applying such a fastening member 8, a hole 9 is drilled from the inside of the stringer 4*a*, 4*b* and/or 4*c* of the staircase element 1 lifted in place, through its wall on the side of the wall, the hole extending into the wall of the building. In this hole, a connecting anchor 10 is injected, which can be e.g. a threaded bar, a bolt, or another suitable elongated, bar-like or tubular piece provided with a fastening member, such as the nut 11 screwed on the threaded bar shown in FIG. 4, to be fastened to its end remaining outside the wall (that is, on the side of the stringer). Using such a fastening member 8, the stringer 4*a*, 4*b* and/or 4*c* can be placed precisely in the correct position. The joint between the hole 9 in the stringer 4*a*, 4*b* and/or 4*c* and the connecting anchor 10 is made with e.g. a steel plate 11 which is welded to both the stringer 4*a*, 4*b* and/or 4*c* and the connecting anchor 10. The diameter of the hole 9 is typically e.g. about 60 mm when the diameter of the connecting anchor 10 is 30 mm. The diameters of the hole 9 and the connecting anchor 10 can also deviate from these dimensions, as needed. The fastening member 11 and the connecting anchor 10 remain inside the stringer 4*a*, 4*b* and/or 4*c*, and the working hole inside the stringer 4*a*, 4*b* and/or 4*c* is sealed for the time of the casting. In this way, the whole joint is embedded in concrete, and besides, it will meet the strength requirements set for the structure in different situations. This fastening method enables flexible dimensioning and still quick installation of the prefabricated and finished product at the work site.

In addition to the fastening at the stringers, the staircase element 1 is fastened at the topmost and the lowermost stair step elements by welding to connecting plates fixed at the edge of the landing.

If an elevator is to be installed in connection with the staircase in the stair hall, a prefabricated partition wall frame 8 is erected on this side of the staircase elements 1. The partition wall frame 8, like the other parts of the staircase element 1, is fastened to the staircase element 1 in connection with its fabrication on the production line of staircase elements 1.

When a staircase formed of staircase elements 1 according to FIGS. 1 to 3 is installed in a stair hall, a staircase element 1 is normally lifted into the stair hall via an opening made in the roof of the stair hall, for example by means of a truck crane or another suitable hoisting device. After this, the staircase element 1 is placed in the correct position between the landings and installed in the above mentioned way by connecting anchors connectable to the wall via screw holes in the stringers 4*a* to 4*c* (e.g. in the way shown in FIG. 4), and by welding the mast 2 and the topmost and the lowermost stair step elements 3 to the connecting plates fixed to the edges of the landings. Because the staircase element 1 comprises prefabricated stair step elements 3 covered with surface pieces, as well as other surfaces finished with e.g. a skim coat and/or paint, the only remaining step is the casting of concrete in the stringers 4*a* to 4*c* and the mast 2. The casting is performed by a particular pressure casting apparatus which can be brought next to the building and from which a pumping hose can be drawn to the casting hole in the bottom part of the first stringer 4*a* or in the bottom part of the mast 2. Upon casting, the mast 2 and the stringers 4*a* to 4*c* are pumped up with concrete, after which the casting holes are closed and the concrete is allowed to cure. After the casting step, the staircase is ready for use. If an elevator shaft is to be formed in connection with the staircase, a partition wall frame is connected to one of the stringers 4*a* to 4*c*, and the partition wall may have been finished already in connection with the fabrication. Normally, in the case of e.g. a rectangular stair hall, the existing walls of the stair hall constitute the other walls of the elevator shaft, whereby the elevator shaft is also ready for the installation of the elevator after the installation of the staircase elements 1.

The staircase element and the method for building a staircase according to the invention can be implemented in many ways different from the example embodiments presented above. For example, the staircase element according to the invention can be provided with, for example, vertical beams pre-installed at the corners between the stringers as well as at other locations of the stringers, if necessary. The outer walls of an elevator shaft, or their frame, can be pre-installed on these vertical beams at the factory. In such a case, a staircase, or both a staircase and an elevator shaft, can be built of staircase elements completely or partly outside the outer walls of a building. Consequently, the invention is not limited to the example embodiments presented above, but it may vary within the scope of the appended claims.

Example 1

A staircase element (1), comprising:

a tubular mast (2) erectable to a vertical position on the floor or a corresponding surface of a stair hall, and fillable with concrete;

stair step elements (3) fixed at their first end stepwise to the mast (2) and branching off radially from the mast (2);

at least one tubular stringer (4*a* to 4*c*) fastened to the second end of the stair step elements (3), fillable with concrete and connectable with fastening members (8) to at least one wall of the stair hall, for supporting the stair step elements (3) at their second end and for anchoring the staircase element (1) to a building.

Example 2

The staircase element (1) according to example 1, comprising two or more stringers (4*a* to 4*c*) perpendicular to each other.

Example 3

The staircase element according to example 2, wherein the lower end of the lowermost stringer (4*a*) is provided with at least one casting hole, and a connecting piece (7*a*, 7*b*) is provided between two successive stringers (4*a* to 4*c*), for guiding concrete through a casting hole in one stringer (4*a*) into all the stringers (4*a* to 4*c*) of at least one staircase element (1).

Example 4

The staircase element (1) according to example 1, wherein the stringer (4*a* to 4*c*) is one curved tubular beam configured to be anchored to the wall of a stair hall with a curved wall.

Example 5

The staircase element (1) according to examples 1 to 3 or 4, comprising at least one fastening member (8) connectable to at least one stringer (4*a* to 4*c*), the fastening member (8) being provided with a connecting anchor (10) anchorable by the injection method to a hole (9) to be formed in the wall of a stair hall.

Example 6

The staircase element (1) according to examples 1 to 4 or 5, st wherein the stair step element (3) comprises a base plate (5*a*) and a cover piece (5*b*) fastened to it.

Example 7

The staircase element (1) according to examples 1 to 5 or 6, wherein the mast (2) comprises an elevator shaft or is part of an elevator shaft.

Example 8

The staircase element according to examples 1 to 6 or 7, wherein at least the mast (2) and the stringers (4*a* to 4*c*) are made of metal.

Example 9

A method for building a staircase, wherein at least one staircase element (1) is a staircase element according to any of the examples 1 to 8 and the method comprises the following method steps:

bringing the staircase element (1) into a stair hall, installing the staircase element (1) in the stair hall in such a way that at least one of the stringers (4*a* to 4*c*) is anchored to at least one wall in such a way that the mast (2) is erected to a primarily vertical position, casting concrete into the mast (2) and at least one stringer (4*a* to 4*c*).

Example 10

The method according to example 9, wherein one or more staircase elements (1) are installed on top of one staircase element (1), to build up a staircase of two or more staircase elements (1) on top of each other.

Example 11

The method according to example 9 or 10, wherein the staircase elements (1) are brought to the stair hall by lifting the staircase elements (1) into the stair hall via an opening formed in its roof.

Example 12

The method according to the example 9, 10 or 11, wherein the staircase is formed of one or more staircase elements (1), which are prefabricated staircase elements (1) equipped with a partition wall frame (8) or a finished partition wall for forming an elevator shaft in the stair hall.

Example 13

The method according to the examples 9 to 11 or 12, wherein one or more staircase elements (1) are fastened to the wall of the staircase by at least one fastening member (8) comprising a connecting anchor (10) to be fitted through a hole provided or to be formed in the wall of the stringer (4*a* to 4*c*), into a hole (9) to be formed in the wall of the stair hall, to be injected and anchored therein, the fastening anchor (10) is anchored to at least one wall of the stringer (4*a* to 4*c*), and the end of the fastening anchor (10) extending to the inside of the stringer (4*a* to 4*c*) is embedded in concrete to be cast into the stringer (4*a* to 4*c*).

Example 14

The method according to the examples 9 to 12 or 13, wherein concrete is cast into one or more stringers (4*a* to 4*c*) of at least one staircase element (1) by pumping concrete via a casting hole at the lower end of the lowermost stringer (4*a*).

Example 15

The method according to the examples 9 to 13 or 14, wherein concrete is cast into the mast (2) by pumping concrete into the mast (2) via a casting hole in its lower part.

What is claimed is:

1. A staircase element, comprising:

a tubular mast erectable to a vertical position onto the floor or a corresponding surface of a stair hall, and fillable with concrete;

stair step elements fastened at their first end stepwise to the mast by welding, screwing or riveting and branching off radially from the mast;

at least one tubular stringer fastened to the second end of the stair step elements, fillable with concrete and connectable with fastening elements to at least one wall of the stair hall, for supporting the stair step elements at their second end and for anchoring the staircase element to a building.

2. The staircase element according to claim 1, comprising two or more stringers perpendicular to each other.

3. The staircase element according to claim 2, wherein the lower end of the lowermost stringer is provided with at least one casting hole, and a connecting piece is provided between two successive stringers, for guiding concrete through a casting hole in one stringer into all the stringers of at least one staircase element.

4. The staircase element according to claim 1, wherein the stringer is one curved tubular beam configured to be anchored to the wall of a stair hall with a curved wall.

5. The staircase element according to claim 1, wherein the fastening elements comprise at least one bracket connectable to the at least one stringer, the at least one fastening member being provided with a connecting anchor anchorable by the injection method to a hole to be formed in the wall of a stair hall.

6. The staircase element according to claim 1, wherein the stair step element comprises a base plate and a cover piece fastened to it.

7. The staircase element according to claim 1, wherein the mast is a proximate part of an elevator shaft.

8. The staircase element according to claim 1, wherein at least the mast and the stringers are made of metal.

9. A method for building a staircase, wherein at least one staircase element is a staircase element according to claim 1, and the method comprises the following method steps:

bringing the staircase element into a stair hall, installing the staircase element in the stair hall in such a way that at least one of the stringers is anchored to at least one wall in such a way that the mast is erected to a primarily vertical position, casting concrete into the mast and at least one stringer.

10. The method according to claim 9, wherein one or more staircase elements are installed on top of one staircase element, to build up a staircase of two or more staircase elements on top of each other.

11. The method according to claim 9, wherein the staircase elements are brought to the stair hall by lifting the staircase elements into the stair hall via an opening formed in its roof.

12. The method according to claim 9, wherein the staircase is formed of one or more staircase elements, which are prefabricated staircase elements equipped with a partition wall frame or a finished partition wall for forming an elevator shaft in the stair hall.

13. The method according to claim 9, wherein one or more staircase elements are fastened to the wall of the staircase by at least one bracket comprising a connecting anchor to be fitted through a hole provided or to be formed in the wall of the stringer, into a hole to be formed in the wall of the stair hall, to be injected and anchored therein, the fastening anchor is anchored to at least one wall of the stringer, and the end of the fastening anchor extending to the inside of the stringer is embedded in concrete to be cast into the stringer.

14. The method according to claim 9, wherein concrete is cast into one or more stringers of at least one staircase element by pumping concrete via a casting hole at the lower end of the lowermost stringer.

15. The method according to claim 9, wherein concrete is cast into the mast by pumping concrete into the mast via a casting hole in its lower part.

* * * * *